US007159957B2

(12) United States Patent
Huber et al.

(10) Patent No.: US 7,159,957 B2
(45) Date of Patent: Jan. 9, 2007

(54) ACTUATOR FOR A MOVABLE PORTION OF AN ARTICLE OF FURNITURE

(75) Inventors: Edgar Huber, Hard (AT); Klaus Mattle, Koblach (AT)

(73) Assignee: Julius Blum Gesellschaft M.B.H., Hochst (AT)

( * ) Notice: Subject to any disclaimer, the term of this patent is extended or adjusted under 35 U.S.C. 154(b) by 7 days.

(21) Appl. No.: 10/321,621

(22) Filed: Dec. 18, 2002

(65) Prior Publication Data

US 2003/0122459 A1 Jul. 3, 2003

(30) Foreign Application Priority Data

Dec. 27, 2001 (AT) ..... 2038/01

(51) Int. Cl.
*A47B 88/00* (2006.01)

(52) U.S. Cl. ..... 312/331; 312/319.5; 312/332; 312/330.1; 312/294

(58) Field of Classification Search ..... 312/319.5, 312/330.1, 331, 319.6, 319.7, 319.8, 332, 312/266–267, 294; 700/237, 241; 49/348, 49/349, 350; 74/422, 421 A
See application file for complete search history.

(56) References Cited

U.S. PATENT DOCUMENTS 3,005,672 A * 10/1961 Becker ..... 312/319.7
3,028,209 A * 4/1962 Hinkel et al. ..... 312/319.7
3,618,060 A * 11/1971 Nina ..... 340/570
3,791,291 A * 2/1974 Macune et al. ..... 101/69
4,084,149 A * 4/1978 Driver et al. ..... 367/95
4,478,004 A * 10/1984 Andrei-Alexandru et al. . 49/72
4,809,254 A 2/1989 Scheffler
4,934,767 A * 6/1990 Hoyt et al. ..... 312/330.1
4,981,275 A * 1/1991 Sheu ..... 348/147
4,986,029 A * 1/1991 Richter ..... 49/349
5,112,134 A * 5/1992 Chow et al. ..... 356/427
5,157,448 A * 10/1992 Lang ..... 399/23
5,200,039 A * 4/1993 Weber et al. ..... 202/197
5,249,858 A * 10/1993 Nusser ..... 312/319.6
5,392,951 A * 2/1995 Gardner et al. ..... 312/319.5
5,797,666 A * 8/1998 Park ..... 312/319.5
5,979,337 A * 11/1999 Clark et al. ..... 108/43
6,007,689 A * 12/1999 Renfrew et al. ..... 204/470
6,317,648 B1 * 11/2001 Sleep et al. ..... 700/216
6,334,542 B1 * 1/2002 Hsu ..... 220/263
6,334,582 B1 * 1/2002 Castronovo ..... 241/29
6,533,375 B1 * 3/2003 Fulterer et al. ..... 312/319.8
6,847,861 B1 * 1/2005 Lunak et al. ..... 700/242
2001/0013745 A1 8/2001 Fulterer et al.

FOREIGN PATENT DOCUMENTS

DE 1017351 10/1957

(Continued)

*Primary Examiner*—Peter M. Cuomo
*Assistant Examiner*—Erika Garrett
(74) *Attorney, Agent, or Firm*—Wenderoth, Lind & Ponack, L.L.P.

(57) ABSTRACT

A movable portion of an article of furniture, in particular a drawer, flap or door, includes at least one preferably electrical drive unit and a triggering device for actuation of the drive unit. The triggering device is at least partially arranged at the movable portion of the article of furniture, and has at least three different switching states. The triggering device has two touch switches (5*a*, 5*b*), preferably mechanical touch switches, IR-touch switches or capacitive touch switches, and the direction of actuation ($Y_1$, $Y_2$, $Z_1$, $z_2$) of the switches is identical to the desired direction of movement ($X_1$, $X_2$) of the moved portion of the article of furniture.

27 Claims, 4 Drawing Sheets

FOREIGN PATENT DOCUMENTS

| | | |
|---|---|---|
| DE | 2611722 | 9/1977 |
| EP | 0312779 A1 | 4/1989 |
| EP | 1125525 A1 | 8/2001 |
| EP | 1155639 A1 | 11/2001 |

* cited by examiner

ACTUATOR FOR A MOVABLE PORTION OF AN ARTICLE OF FURNITURE

BACKGROUND OF THE INVENTION

The invention concerns a movable portion of an article of furniture, in particular a drawer, flap or door, with at least one preferably electrical drive unit and a triggering device for actuation of the drive unit. The triggering device is at least partially arranged at the movable portion of the article of furniture and has at least three different switching states.

Such portions of an article of furniture, in particular drawers, are generally already known. German patent specification DE 1 017 351 describes a device for pulling out or pushing in drawers in articles of furniture, which can be pulled out or in by a drive unit actuated by means of push buttons on the body of the article of furniture. Any possible positioning of the drawer between the fully pushed-in and the fully pulled-out position is possible, by means of the triggering device which is in the form of push buttons. Austrian patent specification AT 398 513 B describes a drawer guide fitment, the drive of which is actuated by a capacitive touch switch arranged at the front panel of the drawer. By touching the touch switch, the drawer moves in or out. European patent application EP 0 957 225 A1 discloses a device for opening a drawer provided with a drive unit, the drive unit being actuated by a triggering element in the form of a touch switch. The two last-mentioned publications each disclose a triggering element which has two switching states. Consequently, after a pulling-out operation has been effected and the triggering element has been actuated, only triggering of the opposite procedure is possible.

U.S. Pat. No. 5,249,858 shows a motor-driven wall cupboard, in which a rocker switch with three switch positions can be arranged at the movable portion of the article of furniture itself. Intuitive operation of that portion of the article of furniture however is not possible as the user has to specifically look for and use the small switching surface.

SUMMARY OF THE INVENTION

The object of the present invention is to provide a drawer of the kind set forth in the opening part of this specification, which makes it possible for the drawer to be conveyed into any position along the pull-out path thereof by means of a drive unit actuated by way of a triggering device and, in that respect, to implement operating comfort which is in keeping with the times.

In accordance with a variant of the invention, the triggering device has two touch switches, preferably mechanical touch switches, IR-touch switches or capacitive touch switches, and the actuation direction of the switches is identical to the desired direction of movement of the moved portion of the article of furniture.

An arrangement on the portion of the article of furniture, for example a drawer or a flap, is particularly user-friendly because the mode of operation differs not at all or only slightly from conventional undriven portions of an article of furniture. The three different switching states make it possible to implement all possible movements of the drawer along the extension path thereof. The limitation to only two procedures, which is frequently encountered in the state of the art, namely retraction when the drawer is open and extension when the drawer is closed, is overcome in that fashion.

In regard to ergonomic operation of a portion of an article of furniture in accordance with the invention, it is found to be necessary for the direction in which a switch is to be actuated to be identical to the desired direction of movement of the drawer. In that way, the drawer according to the invention permits a mode of operation similar to that of conventional undriven drawers. The user pulls a conventional drawer out by gripping a handle arranged, for example, at the front panel of the drawer and pulling it. That familiar way of operating the drawer is made possible to the user by virtue of the fact that the switches are arranged on the drawer in such a manner that actuation thereof is effected by the accustomed form of movement.

With the above-illustrated variants, the triggering element has a switch that can be actuated by the hand of the user. In accordance with further variants of the invention, however, the switch of the triggering device does not have to be directly hand-actuated.

For example, in accordance with a further variant according to the invention, it is possible for the triggering device to have at least one switch which has parts which are fixed with respect to the body of the article of furniture, and parts which are movable relative thereto and which are connected to the movable portion of the article of furniture. The switch is in the form of a drag switch which has at least one, and preferably two, switch contacts which are fixed with respect to the body of the article of furniture, and a movable switch contact which is arranged on a drag element which can be entrained by the movable portion of the article of furniture. In this variant, the user actuates the movable portion of the article of furniture in a conventional manner, for example he pulls on a handle on the drawer. The movement which he causes relative to the body of the article of furniture is then detected by the switch, for example the above-mentioned drag switch, and that initiates supporting assistance by an electrical or pneumatic drive unit.

A further variant of the invention provides that the movable portion of the article of furniture has at least two furniture portion components which are movable relative to each other, and the triggering device is actuated depending on the relative position of the furniture portion components. In this case, a switch is also therefore not actuated directly by the user. On the contrary, the relative movement of two furniture portion components with respect to each other is utilized to give a "switching impulse". By way of example, one furniture portion component can be a handle which is mounted movably to the drawer front or a flap. When the user pulls on the handle, it moves relative to the rest of the portion of the article of furniture. That relative movement can be detected by a switch and can trigger the supporting assistance by the electrical or pneumatic drive unit.

An advantageous embodiment of the invention applies the principle which is known for electrical window lifters in motor vehicles. Specifically, when the switch is briefly rocked, the window moves into the completely opened or closed position, while when dwelling on the switch, the window stops in the position in which it is at the time that the switch is released. Therefore, in general, the operating procedures involved do not have to be freshly learned by the user but are already known. This embodiment is accordingly characterized in that an electronic control device, upon actuation of the triggering device over a short period of time (in particular, when just tapping on a touch switch), causes movement of the portion of the article of furniture into the completely opened or closed position by means of the drive motor of the drive unit.

BRIEF DESCRIPTION OF THE DRAWINGS

Further advantages and features of the invention are described in greater detail with reference to the Figures, in which.

DETAILED DESCRIPTION OF THE INVENTION

Figure 1:
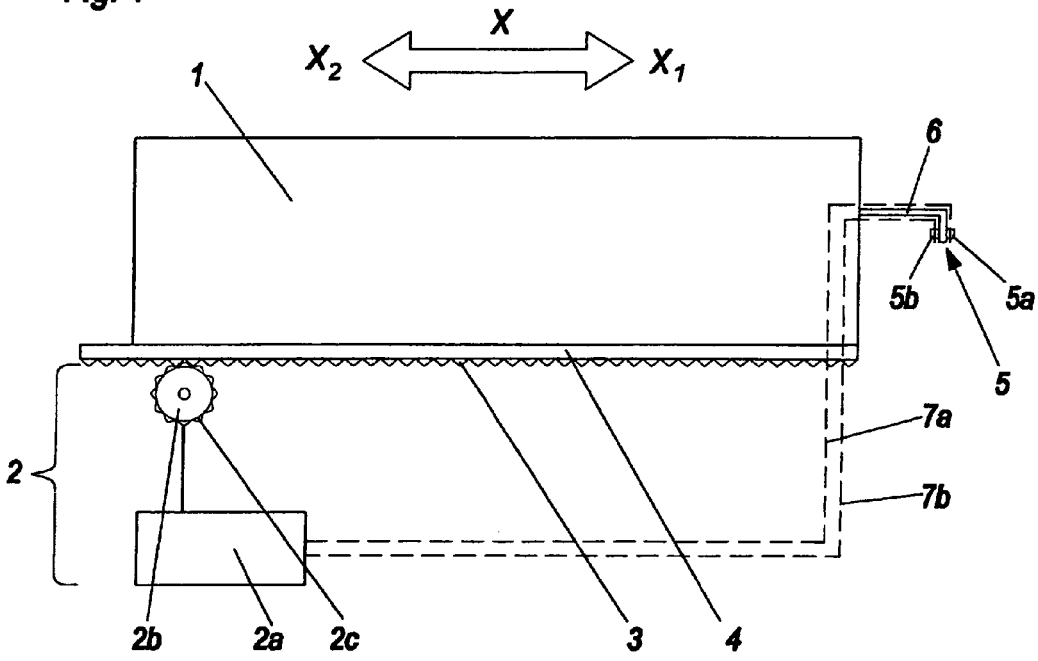
FIG. 1 is a diagrammatic view of an embodiment of a drawer according to the invention.

The drawer 1 illustrated in FIG. 1 is driven by a drive unit 2 comprising an electronic control unit 2*a* and an electric motor 2*b* with a pinion 2*c*. The pinion 2*c* engages a toothed rack 3 arranged at the guide rail 4 of the drawer 1. A rotary movement produced in the motor 2*b* conveys the drawer 1 in the direction $X_1$ or $X_2$ respectively.

The triggering device 5 includes two capacitive touch switches 5*a* and 5*b*, wherein the first touch switch 5*a* is arranged at the front side and the second touch switch 5*b* is arranged at the rear side of a handle 6. When the user touches a touch switch 5*a* or 5*b*, the signal lines 7*a* and 7*b* transmit control signals to the electronic control device 2*a*, which initiates the appropriate motor movement.

Figure 2A:
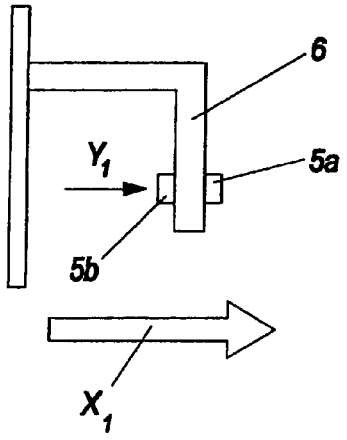
FIGS. 2*a* and 2*b* are diagrammatic representations of a mode of operation when two touch switches are arranged on a handle.

If the user passes his hand under the handle 6 in order to pull out the drawer 1 in the direction $X_1$, he touches the switch 5*b*, more specifically in the direction $Y_1$ (FIG. 2*a*). Touching the switch 5*b* triggers in the electronic control unit 2*a* the signal to move the motor 2*c* in such a way that the drawer 1 is extended.

Figure 2B:
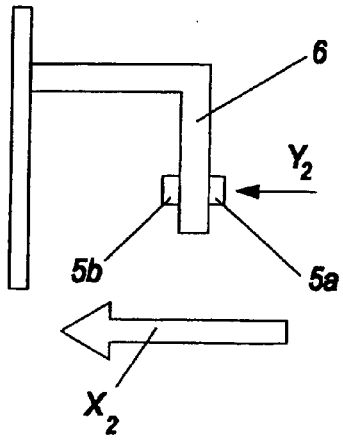

To move the drawer 1 inwardly in the direction $X_2$ the user pushes on the handle 6 in such a way that he touches the switch 5*a*, more specifically in the direction $Y_2$ (FIG. 2*b*). Such contact signals to the electronic control device 2*a* to move the motor 2*c* in such a way that the drawer 1 moves inwardly in the direction $X_2$, for example into the body of an article of furniture.

The setting of the electronic control device 2*a* is advantageously effected in accordance with the principle known in relation to electrical window lifters in motor vehicles in order to achieve the highest possible level of operating comfort and convenience. If the user only briefly taps the switch 5*b* in order to pull out the drawer 1, the drawer 1 moves into the completely pulled-out position. If, however, while the drawer 1 is being pulled out the user taps in the direction $Y_2$ on the switch 5*a*, the drawer 1 stops. When moving outwardly, the drawer 1 can thus be put into any desired position along the extension path of movement thereof. In order to move the stationary drawer 1 from there into the completely retracted position, the user taps the switch 5*a* in the direction $Y_2$ (FIG. 2*b*).

The user, however, should also be able to put the drawer 1 into a desired position along the extension path of movement thereof in such a way that, during the entire duration of the movement, he touches the switch 5*b* with a light pressure in the direction $Y_1$ and releases the switch 5*b* at the desired stopping point, whereby the drawer 1 stops. The corresponding mode of operation is also used in regard to the direction of movement $X_2$ of the drawer 1 by means of the switch 5*a*.

Figure 3:
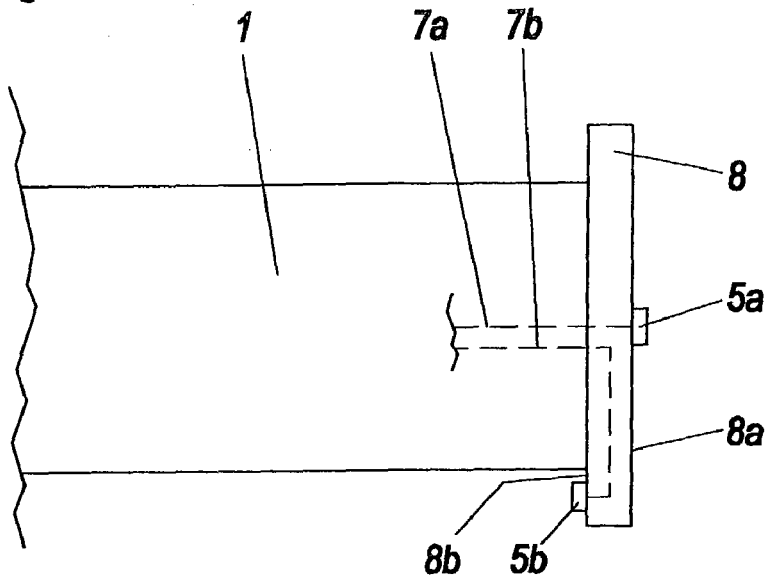
FIG. 3 shows an embodiment of a drawer according to the invention in which a first touch switch is arranged at the front side of the front panel and the other touch switch is arranged at the rear side.

FIG. 3 shows a further embodiment of a drawer according to the invention whose triggering device again includes two touch switches 5*a* and 5*b*. The switch 5*a* is arranged at the front side 8*a* of the front panel 8. Touching that switch (which is in the form of a capacitive touch switch) triggers a movement of the stationary drawer in the direction $X_2$, while touching it when the drawer is moving out in the direction $X_1$ stops the movement of the drawer. The other switch 5*b* is arranged at the rear side 8*b* of the front panel 8. This arrangement is intended for drawers, at the front panel 8 of which no parts are intended to project, such as a handle or a handle strip. In order to ensure a user-friendly mode of operation and in order to retain the identity of the direction of actuation of a switch with the desired direction of movement of the drawer, it is possible to grip under the drawer 1 behind the front panel 8 in order to pull out the drawer. The switch 5*b* is arranged at that location 8*b*. A handle recess on the rear side of the front panel, in which the switch 5*b* is arranged, is not illustrated but is an equally viable structure. That design also allows the front panel 8 to be of a configuration without any projecting handle.

Figure 4:
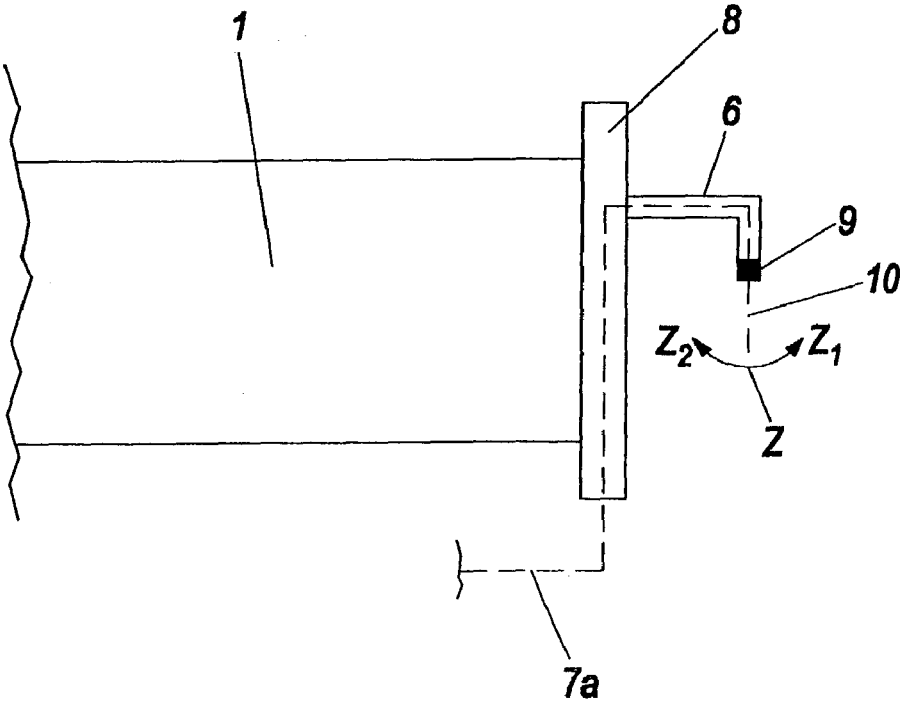
FIG. 4 shows a diagrammatic view of an embodiment with an arrangement of a switch with three switching positions on a handle arranged at the front panel of a drawer according to the invention.

FIG. 4 finally shows an embodiment of a drawer according to the invention, wherein the triggering device includes a mechanical switch 9 whose three switching positions can be set by means of a rocker 10. The switch 9 is arranged at a handle 6 which projects from the front panel 8. The user who pulls out the drawer 1 moves his hand under the handle 6 and then moves his hand in the direction $Z_1$ so that the rocker 10 is moved in the direction $Z_1$. That switching state triggers in the electronic control unit 2*a* the signal to extend the drawer 1. For retraction of the drawer 1, the user employs for example the palm of the hand to apply pressure to the handle 6 so that the rocker 10 is moved in the direction $Z_2$. The triggering device now assumes the switching state in which the electronic control device 2*a* triggers the signal which causes retraction movement of the drawer 1. The above-described operating principle which is already known in relation to electrical window lifters of a motor vehicle can also be implemented in this arrangement.

Figure 5:
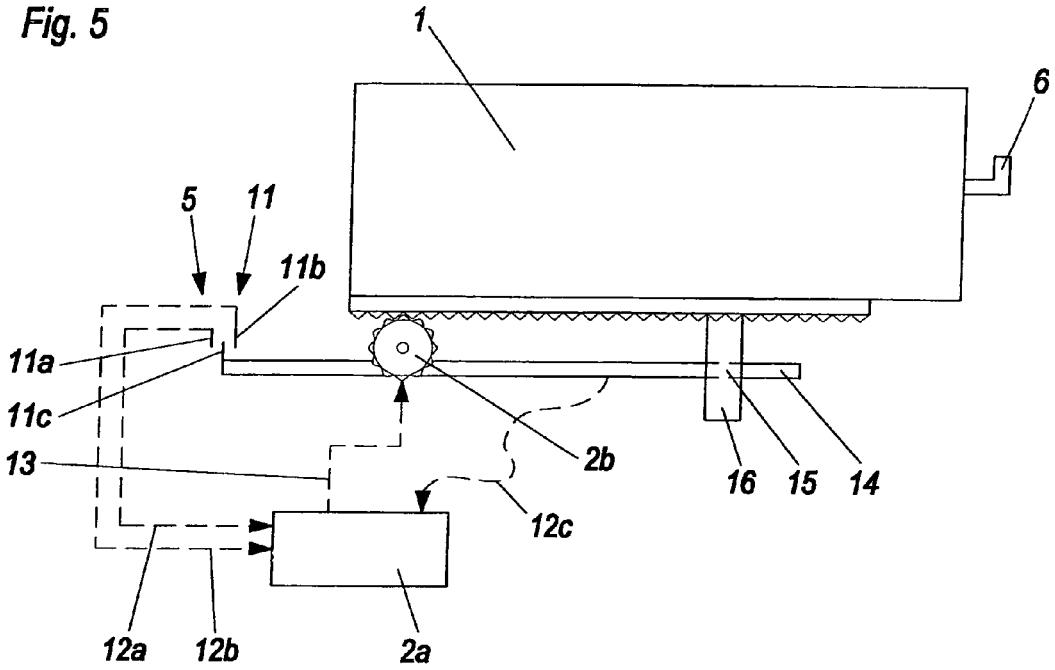
FIG. 5 shows a diagrammatic embodiment with a switch, which is not directly hand-actuated, of the triggering device.

FIG. 5 shows an embodiment in which the switch of the triggering device 5 is not directly hand-actuated, but is in the form of a drag switch 11 including switching contacts 11*a* and 11*b* which are fixed with respect to the body of the article of furniture and a drag contact 11*c*. The contacts 11*a*, 11*b* and 11*c* are connected by way of signal lines 12*a*, 12*b* and 12*c* to the electronic control device 2*a*, which operates the drive motor 2*b* by way of the control line 13. The movable drag contact 11*c* is arranged on a bar 14 which is guided through a bore 15 on an element 16 which is fixed with respect to the drawer. When the drawer 1 is pulled outwardly by means of the handle 6, the bar 14 is also initially moved outwardly in the bore 15 by virtue of the prevailing friction between the element 16 and the bar 14. The contacts 11*b* and 11*c* come to bear against each other and provide for assistance in the drawer-extension movement by means of the drive motor 2*b*. As soon as the contacts 11*c* and 11*b* bear against each other, the bar 14 slides within the opening 15 and does not impede the extension movement. When the drawer is closed again, the bar 14 is moved a short distance again by virtue of the friction involved in the opening 15 until the contacts 11*a* and 11*c* come to bear against each other, which again triggers electrical assistance for the closing movement. After the contacts 11*a* and 11*c* have come into contact with each other, the bar 14 can slide again within the bore 15. The bar 14 thus represents a drag element.

There is also the possibility of the extension movement already starting as soon as the contacts 11*a* and 11*c* have disengaged. Conversely, there is also the possibility of the retraction movement already beginning as soon as the contacts 11*b* and 11*c* separate from each other. In principle, it is also possible to adopt a simplified structure for the switching element, by the provision of only one switching element. Then, closure of the contacts 11*a* and 11*c* denotes reaction, and opening of the contacts 11*a* and 11*c* denotes extension.

To trigger the drag switch in FIG. 5, the drive has to be only briefly moved so that the drag switch can be activated. When using a toothed rack drive that is possible without any problem, without involving additional measures, the motor can be easily moved quite briefly by manual force. When using other drives, for example self-locking drives such as worm drives, in order for the drag switch to operate, there must either be a brief period of decoupling from the drive or there must be a given play which permits a slight movement of the drawer so that the drag switch can switch.

Figure 6:
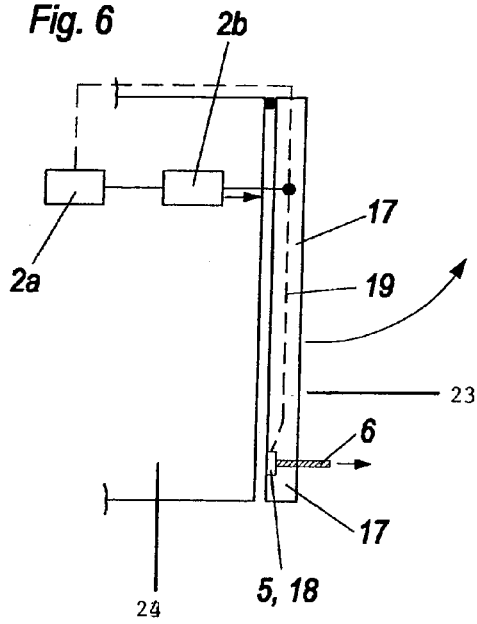
FIG. 6 shows an electrically actuatable flap of an article of furniture, which is operable by way of a movably mounted handle which actuates a switch.

In the case of the structure shown in FIG. 6, the movable portion of the article of furniture is a door 23 connected to a body portion 24 of the article of furniture. The door (movable portion) 23 includes a flap 17 (first movable component) which is driven by way of a drive motor 2*b*. It will be appreciated that this illustration is only highly diagrammatic to represent the mode of operation involved as a principle.

In the embodiment illustrated in FIG. 6, a handle (second movable component) 6 is movably mounted relative to the flap 17 itself. That relative movement can be detected by the switch 18 and thus can actuate a drive motor 2*b* by way of the signal line 19 and the electronic control device 2*a* when the user pulls on the handle.

Figure 7:
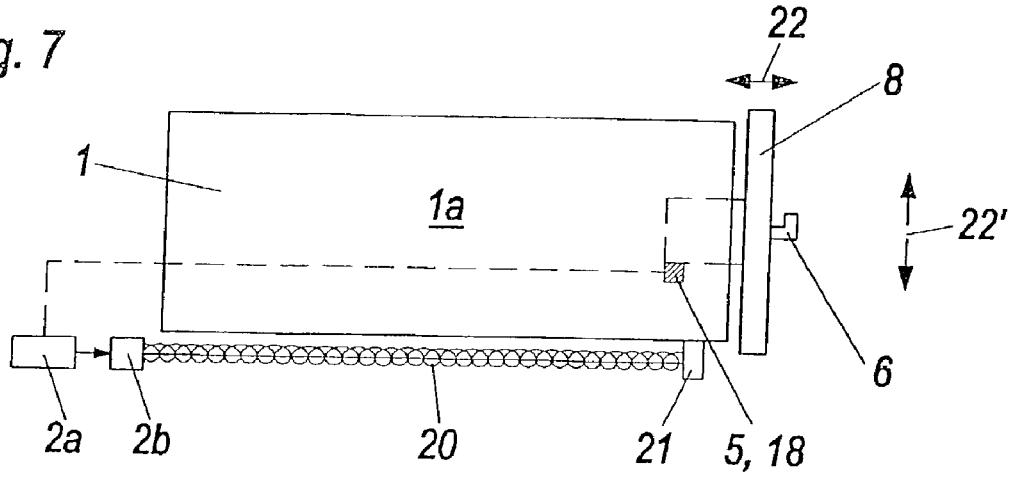
FIG. 7 shows a drawer with a spindle drive, in which the "switching impulse" is derived from the relative movement between the front wall of the drawer and the frame of the drawer.

In the embodiment shown in FIG. 7, the drive is a spindle drive. The drive motor 2 rotates the spindle 20 which runs in a spindle nut 21 which is fixed with respect to the drawer.

In this embodiment, the front panel 8 of the drawer (movable portion) 1 is movable slightly outwardly and inwardly in the direction of the arrow 22 with respect to the lateral frame (first movable component) 1*a*, more particularly preferably against the force of springs (not shown). When the user pulls on the handle 6, the front panel (second movable component) 8 moves outwardly. That relative movement can be detected by the switch element 18, and by way of the electronic control device 2*a* can actuate the drive motor 2*b* in such a way that the extension movement is assisted. Conversely, the switch element 18 can also detect an inward relative movement of the front panel 8 with respect to the drawer 1 and thus actuate the drive motor 2*b* by way of the electronic control device 2*a* for assisting the push-in movement. Thus, the drawer 1 (movable portion) moves relative to a body portion (not shown) of an article of furniture in a moving direction. The panel 8 (the second movable component of drawer 1) moves in the moving direction relative to the frame 1*a* (the first movable component of drawer 1), and the triggering device (switch element 18) activates the drive unit (drive motor 2, spindle 20) based on the position of the panel 8 (second movable component) relative to lateral frame 1*a* (the first movable component) so that the drive unit moves the drawer 1 (movable portion) in the moving direction (i.e., the same direction of movement as the panel 8 (second movable component). The advantage of an embodiment as shown in FIG. 7 (and also FIG. 5) is that no additional switch elements have to be fitted to the visible parts of the article of furniture, in particular the front panel. That, therefore, affords total freedom in terms of design configuration for the front panel, with a handle which is possibly present thereon. It will be appreciated that, as an alternative to the relative movement as indicated by the arrows 22, it is also possible to detect the relative movement of a front panel 8 with respect to the drawer frame 1*a* in a vertical direction as indicated by the arrows 22' in order to control the retraction and extension movement.

Figure 8:
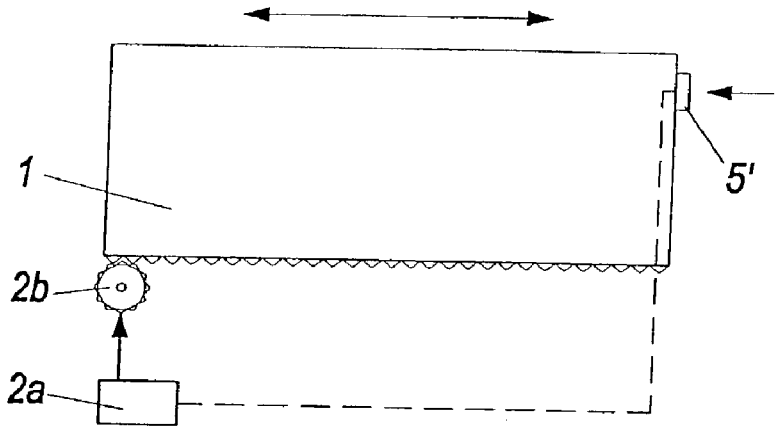
FIG. 8 shows an embodiment of a drawer according to the invention with a switching element, which has only two switching states, of the triggering device (touch switches), with a mode of operation similar to an automobile window lifter.

In the embodiment illustrated in FIG. 8, the drawer has only one touch switch 5' which recognizes only two switching states, namely pressed or touched, or not pressed or not touched. By means of an intelligent electronic control device 2*a*, it is also possible with such a switch to control the movements of the drawer 1. In particular, it can be provided that, when the touch switch is briefly tapped, the drawer is completely extended unless a further tap is effected before that. If, in contrast, the touch switch is touched for a longer period, the drawer is moved out to such an extent as the touch switch is touched. The same logic can be applied when moving the drawer inwardly. Briefly tapping the completely extended drawer causes complete retraction unless the touch switch is touched once again before that. If the drawer is to be retracted by only a part of its movement, the finger is caused to remain on the touch switch longer until the desired position is reached and it is then released. Such functionality of the electronic control device is known in principle in relation to window lifters of automobiles, but here it is still further simplified insofar as there is only a "two-position switch", namely a single simple touch switch.

Control of a handleless drawer can be implemented, for example, by the relative movement of the front panel with respect to the drawer frame 1*a* being detected (similarly to FIG. 7) or using a drag switch (similarly to FIG. 5).

It will be appreciated that the invention is not limited to the illustrated examples. On the contrary, it is also possible for example, that the drive unit has pneumatic drive elements, instead of an electric motor. It is likewise possible for the electronic control device to be integrated into the motor, as is provided in typical servomotors. A toothed rail 3 is not necessarily to be arranged on the guide rail 4 of the drawer, but the transmission of force can be effected in any fashion. Signal transmission from the switches to the electronic control unit does not have to be effected exclusively by cables, and it is also possible to use known communication by way of a pull-out rail made from electrically conductive material.

The invention claimed is:

1. An actuator for a movable portion of an article of furniture, comprising:

a drive unit for moving the movable portion; and a triggering device for actuating said drive unit, said triggering device including a drag switch and a drag element operable to be moved by the movable portion of the article of furniture, said drag switch including a fixed switching contact fixed with respect to a body portion of the article of furniture and a movable switching contact on said drag element.

2. The actuator of claim 1, wherein said drive unit comprises an electrical drive unit.

3. The actuator of claim 1, wherein said fixed switching contact comprises a first fixed switching contact, said drag switch further including a second fixed switching contact fixed with respect to the body portion of the article of furniture.

4. The actuator of claim 1, wherein said drag element comprises a bar guided in frictionally-engaging relationship within a bore at the movable portion of the article of furniture.

5. The actuator of claim 1, wherein the movable portion of the article of furniture is one of a drawer, flap, and door.

6. The actuator of claim 1, wherein said drive unit includes a drive motor for moving the movable portion of the article of furniture and an electronic control device for controlling said drive motor based on a signal received from said triggering device, said electronic control device is operable to cause movement of the movable portion of the article of furniture into an opened or closed position by controlling said drive motor after receiving the signal from said triggering device.

7. The actuator of claim 6, wherein said electronic control device is operable to cause movement of the movable portion of the article of furniture into both the opened and closed position depending on the signal received from said triggering device.

8. The actuator of claim 6, wherein said triggering device is operable to be actuated by tapping the movable portion of the article of furniture.

9. The actuator of claim 8, wherein said triggering device is operable to actuate said drive unit to move the movable portion of the article of furniture over as long a period of time as actuation lasts if actuation of said triggering device is over a longer period of time than a tap.

10. The actuator of claim 1, wherein said drive unit is operable to move the movable portion of the article of furniture in both an open direction and a closed direction based on a signal received from said triggering device.

11. The actuator of claim 1, wherein, during movement of the movable portion of the article of furniture, said triggering device is operable to stop the movement of the movable portion by actuation of said drag switch of said triggering device.

12. An article of furniture comprising:

a body portion;

a movable portion operable to move relative to said body portion; and said actuator of claim 1 mounted to said body portion and said movable portion.

13. The actuator of claim 1, wherein said fixed switching contact comprises a first fixed switching contact, said drag switch further including a second fixed switching contact fixed with respect to the body portion of the article of furniture and spaced apart from said first fixed switching contact, said movable switching contact being arranged between said first fixed switching contact and said second fixed switching contact.

14. The actuator of claim 13, wherein said drag element is operable to move said movable switching contact into contact with one of said first fixed switching contact and said second fixed switching contact, said triggering device being operable to generate a signal when said movable switching contact contacts one of said first fixed switching contact and said second fixed switching contact, and to transmit the signal to said drive unit.

15. The actuator of claim 1, wherein said movable switching contact is adjacent to said fixed switching contact, said drag element being operable to move said movable switching contact into and out of contact with said fixed switching contact, said triggering device being operable to generate a signal when said movable switching contact contacts said fixed switching contact, and to transmit the signal to said drive unit.

16. An article of furniture, comprising:

a body portion;

a movable portion movable relative to said body portion in a moving direction, said movable portion including a first movable component and a second movable component movable in the moving direction relative to said first movable component;

a drive unit for moving said movable portion in the moving direction; and a triggering device for actuating said drive unit based on a position of said second movable component relative to said first movable component.

17. The article of furniture of claim 16, wherein said drive unit comprises an electrical drive unit.

18. The article of furniture of claim 16, wherein said second movable component comprises a handle movably supported relative to said first movable component.

19. The article of furniture of claim 16, wherein said first movable component comprises a lateral drawer frame and said second movable component comprises a front panel of said lateral drawer frame.

20. The article of furniture of claim 16, wherein said movable portion comprises one of a drawer, a flap, and a door.

21. The article of furniture of claim 16, wherein said drive unit includes a drive motor for moving said movable portion and an electronic control device for controlling said drive motor based on a signal received from said triggering device, said electronic control device is operable to cause movement of said movable portion into an opened or closed position by controlling said drive motor after receiving the signal from said triggering device.

22. The article of furniture of claim 21, wherein said electronic control device is operable to cause movement of said movable portion into both the opened and closed position depending on the signal received from said triggering device.

23. The article of furniture of claim 21, wherein said triggering device is operable to be actuated by tapping said second movable component.

24. The article of furniture of claim 23, wherein said triggering device is operable to actuate said drive unit to move said movable portion over as long a period of time as actuation lasts if actuation of said triggering device is over a longer period of time than a tap.

25. The article of furniture of claim 16, wherein said drive unit is operable to move said movable portion in both an open direction and a closed direction based on a signal received from said triggering device.

26. The article of furniture of claim 16, wherein, during movement of said movable portion, said triggering device is operable to stop the movement of said movable portion by actuation said triggering device.

27. The article of furniture of claim 16, wherein said second movable component is mounted directly to said first movable component.

* * * * *